US005856641A

United States Patent [19]

Schreiber et al.

[11] Patent Number: 5,856,641

[45] Date of Patent: Jan. 5, 1999

[54] SWITCH HAVING RAISED CONTACT FEATURES AND A DEFLECTABLE SUBSTRATE

[75] Inventors: Chris M. Schreiber, Lake Elsinore; Eric Dean Jensen, Irvine; Bao Le, Santa Ana, all of Calif.

[73] Assignee: Packard Hughes Interconnect Company, Irvine, Calif.

[21] Appl. No.: 4,387

[22] Filed: Jan. 8, 1998

[51] Int. Cl.[6] ..... H01H 9/00; H01H 13/70

[52] U.S. Cl. ..... 200/1 B; 200/5 A; 200/512; 200/292

[58] Field of Search ..... 200/1 B, 5 A, 200/86 R, 512, 517, 511, 275, 292

[56] References Cited

U.S. PATENT DOCUMENTS

| | | | |
|---|---|---|---|
| 3,699,294 | 10/1972 | Sudduth | 200/5 A X |
| 3,987,259 | 10/1976 | Larson | 200/5 A |
| 4,301,337 | 11/1981 | Eventoff | 200/5 A |
| 4,403,272 | 9/1983 | Larson et al. | 361/398 |
| 4,463,234 | 7/1984 | Bennewitz | 200/159 B |
| 4,490,587 | 12/1984 | Miller et al. | 200/5 A |
| 4,551,586 | 11/1985 | Lataslewicz | 200/5 A |
| 4,799,083 | 1/1989 | Knodt | 355/14 R |
| 4,922,070 | 5/1990 | Dorinski | 200/512 |
| 4,994,634 | 2/1991 | Tanji et al. | 200/5 A |
| 5,072,077 | 12/1991 | Klein | 200/292 X |
| 5,147,208 | 9/1992 | Bachler | 439/67 |
| 5,177,330 | 1/1993 | Takahashi et al. | 200/5 A |
| 5,207,887 | 5/1993 | Crumly et al. | 205/78 |
| 5,350,890 | 9/1994 | Fairbrother et al. | 200/5 A |
| 5,448,028 | 9/1995 | Filion et al. | 200/52 R |
| 5,559,311 | 9/1996 | Gorbatoff | 200/513 |

*Primary Examiner*—J. R. Scott
*Attorney, Agent, or Firm*—Cary W. Brooks

[57] ABSTRACT

A variable rate pressure sensitive electrical device or switch. The switch includes a first substrate and a plurality of electrical circuit traces thereon. A first electrical trace is provided having a first set of raised contact features or bumps projecting from a prevalent planar portion of first electrical trace. At least a second electrical trace is provided having a second set of raised contact features or bumps extending above a planar portion of second electrical trace. The first and second electrical traces and associated raised contact features are constructed and arranged so that the height of the first set of raised contact features is greater than the height of the second set of raised contact features. A second substrate is provided with an electrically conductive element. At least one of the first and second substrates is deflectable and at least one of the first and second substrates is moveable with respect to the other so that the second substrate can make contact with the first set of raised contact features in a first position, and in a second position the second substrate can make contact with both sets of raised features to provide an electrical path across the first and second electrical traces.

25 Claims, 3 Drawing Sheets

SWITCH HAVING RAISED CONTACT FEATURES AND A DEFLECTABLE SUBSTRATE

TECHNICAL FIELD

The invention relates to an electrical switch, and more particularly to a switch having an electronic circuit with raised contact features.

BACKGROUND OF THE INVENTION

A variety of contact switches are known. Filion et al, U.S. Pat. No. 5,448,028, discloses an arm rest electrical switch arrangement for soft interior trim panels. The switch has a flexible skin including indented or depression areas shaped and oriented to receive a person's finger tip. A membrane switch is encapsulated in a foam layer adjacent to the depression area and positioned inside a soft interior trim panel and fixed in position during foaming and curing of the foam layer. The application of pressure with a finger in the depression area will close the membrane switch. This is an on/off type switch and can be utilized to raise or lower windows or to move mirrors in an automobile.

Latasiewicz, U.S. Pat. No. 4,551,586, discloses a membrane switch assembly having a plurality of contact bearing layers. Each contact bearing layer contains a plurality of contact members connected to a plurality of leads which extend from the switch assembly. The contact members are placed as desired in registration with each other or with apertures in spacer layers. This arrangement permits contact between desired contact members themselves, between desired contact members in a base/ground layer or between individual contact members in the base layer. A substantial number of possible combinations of contact members enables such a switch assembly to be readily adapted to a number of control patterns as dictated by the switching requirements of the desired device. Nevertheless, this assembly is also limited to on/off type switching.

Bennewitz, U.S. Pat. No. 4,463,234, discloses a tactile feel membrane switch assembly. A plurality of membrane switches in a keyboard array are provided with tactile feel utilizing a metal snap dome and a force actuator positioned above the membrane switch. The tactile feel is provided by a sudden decrease in force during actuation of the switch. A snap dome, a force actuator, a dome enclosure and an overlayer are mounted above the membrane switch. These are all provided with a planar, layered construction which enables the metal dome to be free to deflect through its specified travel. The full travel of the metal dome will provide acceptable tactile feel response. When the dome snaps through, it engages a force actuator which forces the membrane down causing the switch contacts to close. Again, this type of switch is also limited to on/off switching.

Larson et al, U.S. Pat. No. 4,403,272, discloses a membrane switch interconnect tail and printed circuit board connection. The switch includes a substrate and a membrane layer with a plurality of conductive elements formed on each of the layers. The layers are conveniently separated by a spacer. The conductive elements are arranged into a pattern forming switch sites or locations. A particular switch is closed by applying pressure to a membrane at the switch location. A connecting tail is attached to a substrate layer. The tail includes a raised portion including a plurality of individual bumps. The bumps may be formed by embossing them in the tail member. Similarly, this switch is also limited to on/off applications.

The present invention provides alternatives and advantages over the prior art.

SUMMARY OF THE INVENTION

In general, this invention includes a variable rate pressure sensitive electrical device or switch. The switch includes a first substrate and a plurality of electrical circuit traces thereon. A first electrical trace is provided having a first set of raised contact features or bumps extending above a planar portion of first electrical trace. At least a second electrical trace is provided having a second set of raised contact features or bumps extending above a planar portion of second electrical trace. The first and second electrical traces and associated raised contact features are constructed and arranged so that the height of the first set of raised contact features is greater than the height of the second set of raised contact features. A second substrate is provided with an electrically conductive element. At least one of the first and second substrates is deflectable and at least one of the first and second substrates is moveable with respect to the other so that the second substrate can make contact with the first set of raised contact features in a first position, and in a second position the second substrate can make contact with both sets of raised features to provide an electrical path across the first and second electrical traces.

In one embodiment of the present invention first and second electrical traces are provided each having a first set of raised contact features or bumps extending above a planar portion of the first electrical trace. The first electrical trace acting as an incline source of current to the switch. The second electrical trace having a first resistance associated therewith and having a second set of raised electrical contact features. Preferably, the first and second sets of raised contact features have the same height. At least a third electrical trace is provided having a third set of raised contact features or bumps extending above a planar portion of the third electrical trace, and wherein the third set of raised contact features has a height less than the first and second sets of raised electrical contact features. The third electrical trace having an electrical resistance different from that of the second electrical trace. An elastomeric dome overlies the sets of raised features and includes a compressible electrically conductive contact pad on an underside of the dome and positioned over the raised contact features. When the elastomeric dome is depressed, the contact pad first engages the set of raised contact features of the first and second electrical traces providing an electrical connection therebetween and having a resistance associated with the second electrical trace. As the elastomeric dome is depressed further, the compressible contact pad makes contact with the raised features on the third electrical trace. The circuit may be designed so that the resistance of the second and third electrical traces are in parallel thus providing a variable rate switch. Additional electrical traces within different resistances and raised contact feature heights may also be provided.

In another embodiment of the present invention, first, second, third and additional electrical traces made be provided as described above. The contact pad under the elastomeric dome may be substantially rigid and have a planar contact surface. A compressible pad may be provided under a flexible substrate carrying the electrical traces. As the dome is depressed, the substantially rigid contact pad engages the first and second sets of raised features to close the circuit and provide an electrical connection with a resistance associated with the second electrical trace. When the dome is depressed further, the first and second sets of raised features are pushed downward and the compressible pad compresses under the raised features to lower the relative height of the first and second sets of raised features so that the planar surface of the substantially rigid contact pad engages the third set of raised contact features providing an electrical connection to the third electrical trace having a second resistance associated therewith. The elastomeric dome may be depressed further to engage raised contact features of additional electrical traces in a similar fashion to provide a variable rate contact switch.

In another embodiment of the present invention, a depressible cap is provided with a substantially flat contact surface underneath for engaging the raised features of the electrical circuit. The contact surface is backed by a substantially rigid substrate. A compressible pad is positioned under a flexible circuit carrying the electrical traces as described above.

In another embodiment of the present invention, the contact surface on the underside of the depressible cap includes raised contact features which are positioned to engage contact pads or raised features on the electrical circuit below.

These and other objects, features and advantages will become apparent from the following brief description of the drawings, detailed description and appended claims and drawings.

DESCRIPTION OF THE PREFERRED EMBODIMENT

Figure 1A:
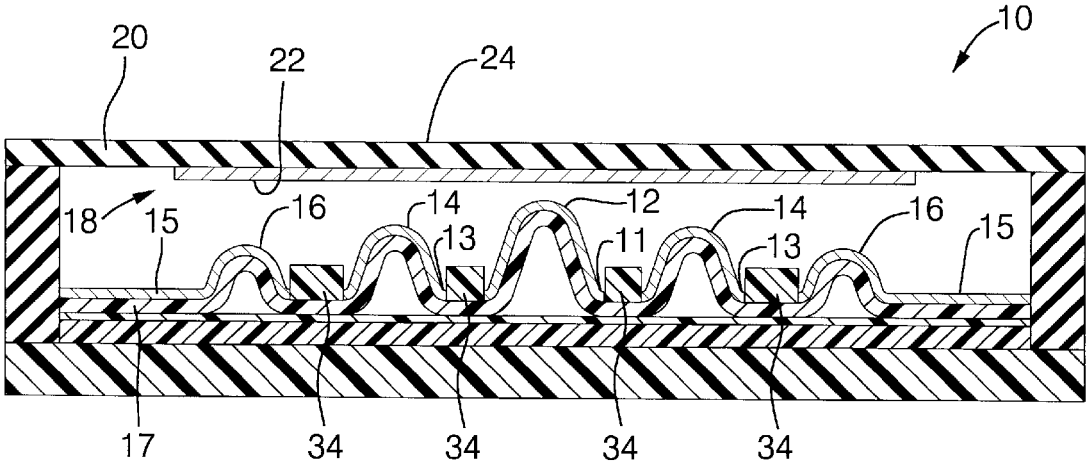
FIGS. 1A–1C are sectional views illustrating various configurations of a variable rate pressure sensitive switches according to the present invention.

FIG. 1A is a sectional illustration of a switch 10 according to the present invention showing an electrical circuit with electrically conductive raised features in a circular pattern with an increasing progression of the height of the raised features extending from the outside to the inside of the circular configuration as viewed from the top of the circuit. Although circular circuit configurations are illustrated, other configurations such as a linear arrangement of the raised features are within the scope of this invention. An electrical circuit 14 is provided on a first substrate 17 which may or may not be further supported by an elastomer pad. The substrate may be solid and rigid or may be of a flexible material such as a polyimide layer. A first electrical trace 11 provided on the substrate includes a first set of raised contact features or bumps 12 which includes at least one raised contact feature. The first electrical trace provides an in-line source of current to the switch.

A second electrical trace 13 is provided having a second set of raised contact features or bumps 14. The second set of raised contact features 14 preferably have a height less than the first set of raised contact features 12, but may have the same height or greater than the raised contact for the in-line source of current. The second electrical trace has a first resistance associated therewith. Likewise, a third electrical trace 15 may be provided having a third set of raised contact features or bumps 16 which is different from the height of the first set or second set of raised contact features 14. Preferably the third set of raised contact features 16 has a height less than the second raised contact features 14. The third electrical trace 15 has a second resistance which is different from the resistance of the second electrical trace 13.

A second substrate 18 is provided and is electrically conductive or an electrically layer is carried on the underside of a dielectric layer 20. The second substrate 18 is positioned above the various sets of raised features and the switch is constructed and arranged so that the first and second substrates are movable toward each other. The second substrate 18 may take on a variety of forms such as a metal dome, a flexible plastic sheet 20 having a conductive metal foil 22 on a face thereof or preferably, an electrically conductive compressible material such as elastomeric or foam. Preferably the second substrate 18 is moved towards the raised features 12, 14, 16 by an operator placing a finger on the topside 24 of the substrate and pushing down on the same or a keycap carrying the substrate 18. In the first position, the second substrate 18 engages the first and second sets of raised features 12, 14 thus closing a circuit and so that current flows through the second electrical trace 13 at a rate corresponding to the resistance of the second electrical trace. As the operator first applies additional pressure to the second substrate 18, the second substrate deflects so that the second substrate engages both the first, second and third sets of raised features 12, 14, 16 causing a short across the second and third electrical traces 13, 15 and thus causing a variation in the current flowing through the switch associated with the resistance in the second and third electrical trace. The raised contact features or bumps 12, 14, 16 may include an upper contact metal layer such as gold, Pd or Ag and an underlying conductor such as copper.

Figure 1B:
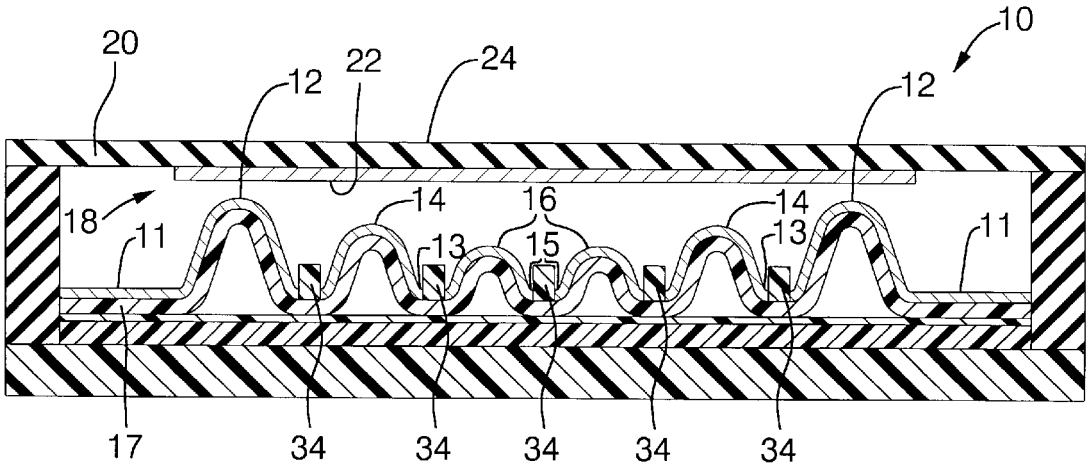

FIG. 1B illustrates a switch like that in FIG. 1A but with a decreasing progression in the height of the raised feature from the outside to the inside.

Figure 1C:
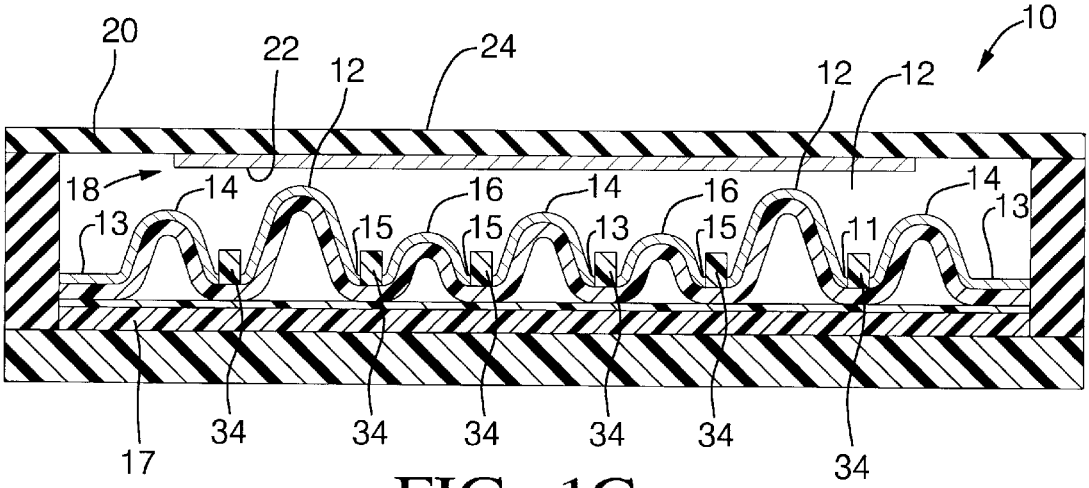

FIG. 1C illustrates a switch like that in FIGS. 1A–1B but with a random orientation of the raised features by height.

Figure 3:
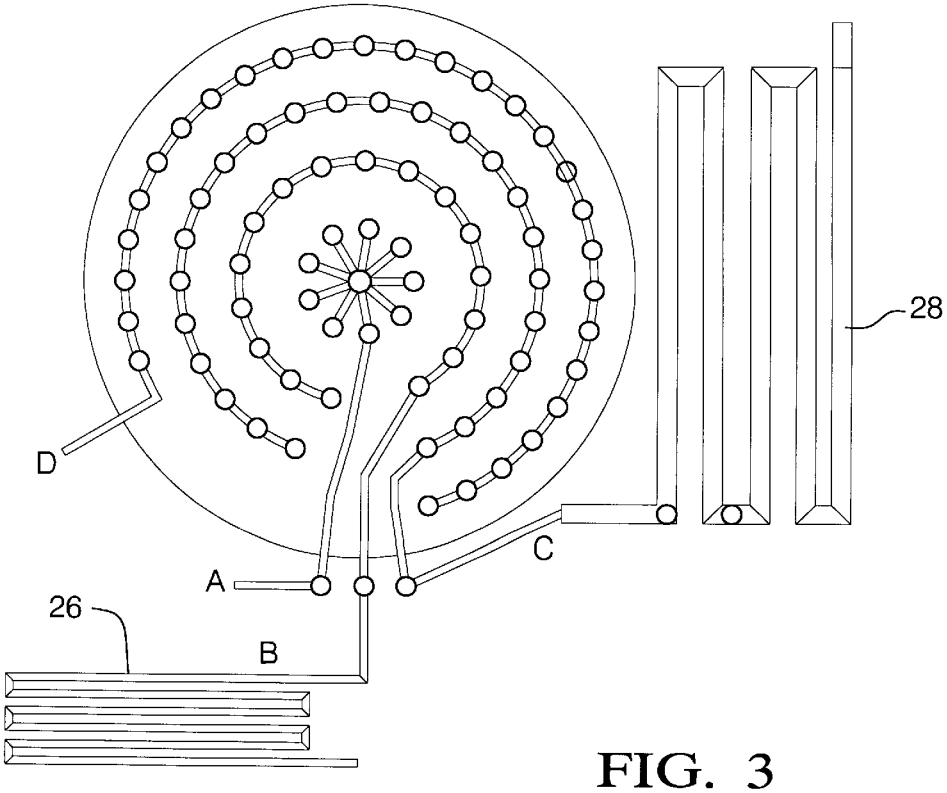
FIG. 3 is a top view of a circuit for a switch according to the present invention.

As illustrated in FIG. 3, current flows into the circuit defined on the first substrate through a first electrical trace (line A). A second electrical trace (line B) can be provided having a resistive path 26 for limiting the current flow through the second electrical trace. A third electrical trace (line C) may also be provided with a second resistive path 28 so that the third electrical trace has a resistance different from the first or second electrical traces. Of course, a fourth electrical trace (line D) may be provided without any substantial resistive path. The resistive paths connected to the electrical traces can be made in a manner known to those skilled in the art.

Figure 2A:
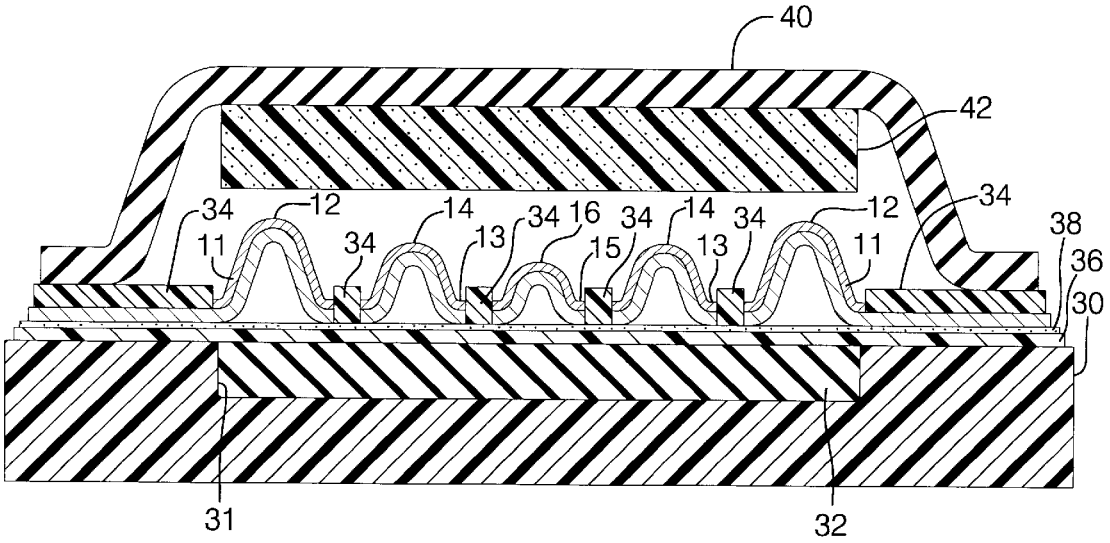
FIGS. 2A–2C illustrate various embodiments of the present invention.

FIG. 2A illustrates one embodiment of a switch according to the present invention that includes a rigid support substrate 30 having a well 31 formed therein and a compressible layer 32 such as elastomer pad received in the well 31. A flexible circuit overlies the elastomer pad 32 and includes copper traces 11, 13, 15 with raised electrical contact features 12, 14, 16 positioned over the elastomer pad. The copper traces may have portions encapsulated by an insulating cover 34 and an insulative film 36 with an adhesive 38 interposed between the copper traces and the film. An elastomeric dome 40 is provided over the raised electrical contact features and includes a conductive pellet 42 on the underside and which may or not be made from a compressible material such as an elastomer.

Figure 2B:
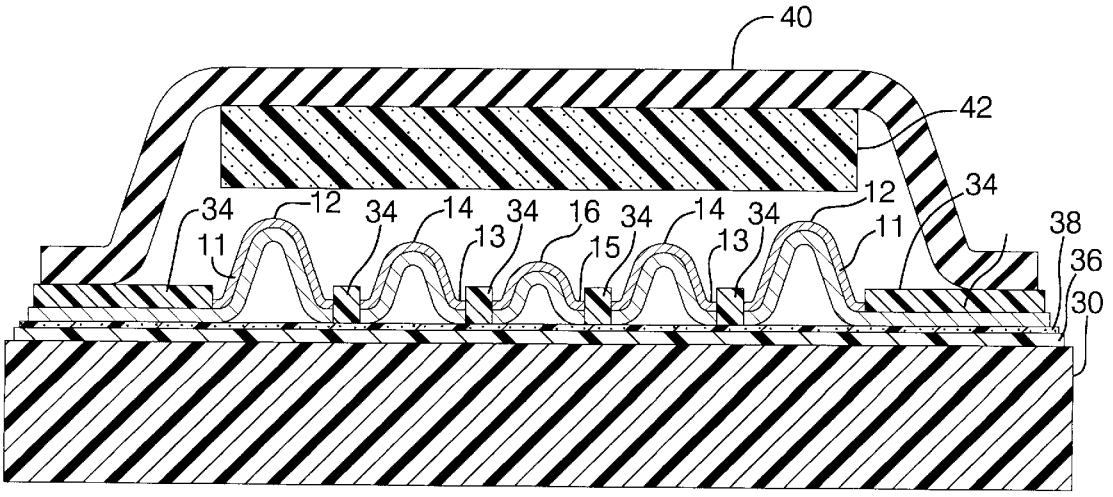

FIG. 2B illustrates another embodiment of the present invention including a switch similar to FIG. 2A. However, the support substrate 30 is relatively rigid along its length and the conductive pellet is made from a compressible pad such as an electrically conductive elastomer.

Figure 2C:
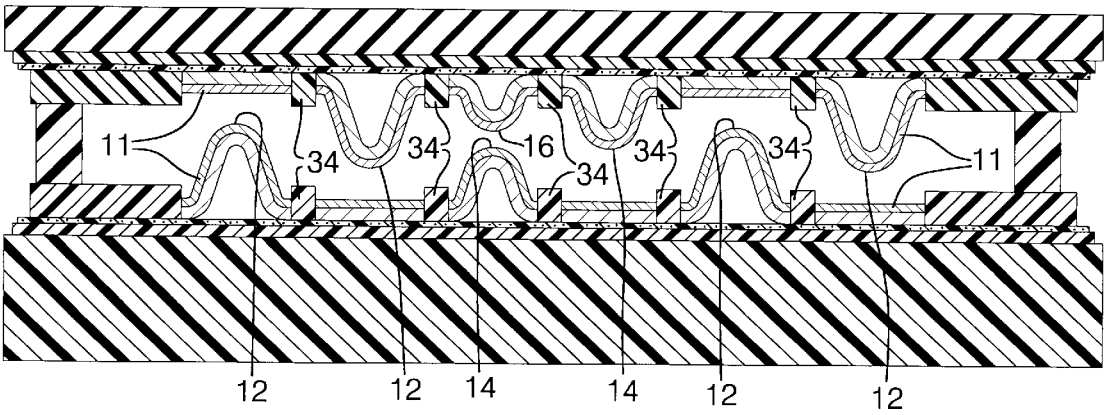

FIG. 2C illustrates an alternative embodiment using a limited number of raised contact features (bumps) in mating parts to obtain a variety of switch closing sequences.

A flexible circuit having raised contact features can be made by a variety of methods, one of which is described in Crumly et al, U.S. Pat. No. 5,207,887, entitled "Semi-Additive Circuitry with Raised Features Using Formed Mandrels", issued May 4, 1993, the disclosure of which is hereby incorporated by reference. The Crumly et al process is briefly described hereafter.

A mandrel method of making a flex circuit with raised features as described in Crumly et al U.S. Pat. No. 5,207,887 is generally described as follows.

A stainless steel plate forms a mandrel having a forming surface in which is provided one or a plurality of depressions or dimples, which will define raised features of the resulting circuitry.

The mandrel and its depression or depressions is then coated with a copper coating, typically referred to as flash plated, which covers the entire surface of the mandrel, including the surface of the depressions. The flash plated copper is applied by electroplating or other known techniques and provides a thin conductive coating that prevents the adhesive (that will be used to laminate the circuit substrate) from adhering to the mandrel surface. Flash plating is a conventional electrolytic plating formed in a very short or momentary operation so that only a very thin plating coat is provided. The flash plated coat is very thin compared to the thickness of the electrical circuit traces that are made. For example, for a circuit trace of 1 ½ mil thickness, a flash plating of copper on the mandrel will have a thickness of 0.01 to 0.2mils. The thin flash plating is employed because it can be relatively easily released from the stainless steel mandrel, and, in addition, may be readily removed from the lamination after separation from the mandrel by a flash etching, which is a very short time or momentary etching process. Obviously, other methods for coating the mandrel with a very thin coat of conductive material that is readily separable from the mandrel and which can be readily removed from the completed circuit traces may be employed in the place of the electrolytic flash plating. Such methods may include sputtering, vapor deposition and electroless plating. If deemed necessary or desirable, the mandrel may be made of a non-electrically conductive material because the thin electrically conductive coating itself enables the additive electroplating of the circuit traces and raised features. The coating, for a dielectric mandrel, can be applied by electroless plating, puttering, or additional conductive particles in solution. No pattern of non-conductive material, such as Teflon®, is permanently affixed to the mandrel. Instead, the flash plated copper is coated with a photoresist, which is then optically exposed through a mask defining a pattern of the desired circuit and developed. The photoresist that has not been polymerized is then removed to leave the partially completed assembly in the configuration illustrated. The flash plated copper coating now bears a pattern of photoresist that is a negative pattern of the circuit trace pattern to be fabricated with this mandrel.

The mandrel assembly is then subjected to a suitable additive electroforming process, such as, for example, electroplating, to plate up copper traces, including trace and a raised feature pad, including a raised feature in the depression. The copper traces are plated directly onto those portions of the flash plated copper coating that are not covered by the negative pattern of developed photoresist. Thus the plating process simultaneously forms both the circuit traces and the raised features. The raised features are partly hollow, having a depression or dimple. If deemed necessary or desirable, the depress formed in the electroplated raised feature may be filled with a solid material by placing a drop of epoxy in the depression and then allowing the epoxy to cure.

The photoresist is then stripped to leave the circuit traces and raised features on the flash plated copper coating which is still on the mandrel. Now a layer of a suitable dielectric and adhesive, such as, for example, a layer of Kapton™ and an adhesive, are laminated to the mandrel assembly with the traces and circuit features thereon under suitable high temperatures and pressures. This causes the Kapton™ and adhesive to flow into the spaces between the traces and thereby contact traces and pads on three sides. Only that side of the traces and pads that is directly in contact with the flash plated copper on the mandrel is not contacted by the adhesive substrate.

The assembly now includes the mandrel, the flash plated copper, traces, pads and features, and the Kapton™/adhesive substrate.

The circuit assembly is then removed from the mandrel. Because only the flash plated copper contacts the mandrel, this may be readily separated, and no adhesive of the substrate is in contact with the mandrel. Thus it will be seen that because the mandrel has been initially coated with the protective layer of the flash plated copper, the assembly of dielectric/adhesive substrate and circuit traces and raised features can be readily separated from the mandrel, together with the flash plated copper coating.

After separation from the mandrel, the flash plated copper coating, which covers the entire lower surface of the assembly is removed by a flash etching process to yield the finished or substantially finished subassembly. The subassembly is ready for the coverlay lamination, which comprises the standard process for covering at least the side of the subassembly bearing the conductive traces with an insulative coverlay.

If deemed necessary or desirable, the removal of the flash plated copper coating may be controlled by a "stop" layer of gold or nickel, which will protect the thicker copper circuit during flash etch removal of the flash plated copper. To this end, the flash coated mandrel with its photolithographically defined resist pattern in place, may be plated with a thin layer of gold, about 0.00006 inches thick, upon which the circuitry will be plated. This patterned gold "stop" layer allows the flash plated copper to be removed by the flash etching from the dielectric, but protects the copper circuit.

We claim:

1. An electrical device comprising:

a first substrate having a first electrical trace on the first substrate, the first electrical trace having a first set of raised electrical contact features extending above a planar portion of the first electrical trace;

a second electrical trace on the first substrate, the second electrical trace having a second set of raised electrical contact features extending above a planar portion of the second electrical trace, the second set of raised electrical contact features having a height less than the first set of raised electrical contact features;

a second substrate having an electrically conductive portion and in a first position the second substrate is spaced a distance from the raised electrical contact features, the first and second substrates being movable with respect to each other so that in a second position the second substrate engages the first set of raised electrical contact features only, and in a third position the conductive portion of the second substrate engages both the first and second sets of raised electrical contact features.

2. An electrical device as set forth in claim 1 wherein the second substrate is deflectable.

3. An electrical device as set forth in claim 1 wherein the second substrate comprises a compressible material.

4. An electrical device as set forth in claim 1 wherein the second substrate comprises an elastomeric layer.

5. An electrical device as set forth in claim 1 wherein the second substrate comprises an electrically conductive compressible material.

6. An electrical device as set forth in claim 1 wherein said second substrate comprises a foam layer.

7. An electrical device as set forth in claim 1 wherein said second substrate comprises foam having an electrically conductive layer attached thereto.

8. An electrical device as set forth in claim 1 wherein said second substrate comprises a collapsible dome.

9. An electrical device as set forth in claim 1 wherein said second substrate comprises a collapsible dome having an electrically conductive pellet attached to an underside of the dome.

10. An electrical device as set forth in claim 8 wherein said dome is metal.

11. An electrical device as set forth in claim 1 wherein the first substrate includes a flexible circuit having an underlying compressible layer.

12. An electrical device as set forth in claim 11 wherein the compressible layer is an elastomer.

13. An electrical device as set forth in claim 11 wherein the compressible layer is a foam.

14. An electrical device as set forth in claim 11 wherein the compressible layer is a rubber.

15. An electrical device as set forth in claim 1 wherein the first electrical trace has a first electrical resistance.

16. An electrical device as set forth in claim 1 wherein the second electrical trace has a second electrical resistance different from the first electrical resistance of the first electrical trace.

17. An electrical device as set forth in claim 1 further comprising a third electrical trace having raised electrical contact features smaller than the second set of raised electrical contact features.

18. An electrical device as set forth in claim 17 wherein the third electrical trace has a third electrical resistance different from the other electrical traces.

19. An electrical device as set forth in claim 1 wherein the second substrate comprises an electrically conductive compressible material.

20. An electrical device comprising a first substrate having a first electrical trace on the first substrate, the first electrical trace having a first set of raised electrical contact features extending above a planar portion of the first electrical trace, a second electrical trace on the first substrate, the second electrical trace having a second set of raised electrical contact features extending above a planar portion of the second electrical trace, the second set of raised electrical contact features having a height less than the first set of raised electrical contact features in relationship to the surface of the first substrate on which the electrical traces are carried, a second substrate being electrically conductive and in a first position the second substrate is spaced a distance from the raised electrical features, the first and second substrates being movable with respect to each other so that in a second position the second substrate engages only the first set of raised electrical contact features, and in a third position the second substrate engages both the first and second sets of raised electrical contact features, and wherein said first substrate comprises a flexible circuit having an underlying compressible layer, and said second substrate is relatively rigid so that in the second position the flexible circuit is pushed into the compressible layer in the area immediately under at least the first set of raised electrical features.

21. An electrical switch comprising a first substrate having a first electrical trace thereof, the first electrical trace having a first set of raised electrical contact features extending above a planar portion of the electrical trace, the first electrical trace providing an in-line source of current to the switch, a second electrical trace on the first substrate, the second electrical trace having a second set of raised electrical contact features extending above a planar portion of the second electrical trace, a third electrical trace on the first substrate and having a third set of raised electrical contact features of a height different than the second set of raised electrical contact features, the third electrical trace having a second resistance which is different than the resistance for the second electrical trace, a second substrate being electrically conductive and in a first position the second substrate is spaced a distance from the raised electrical features, the first and second substrates being movable with respect to each other so that in a second position the second substrate engages the first and second sets of raised electrical contact features, and in a third position the second substrate engages the first, second and third sets of raised electrical contact features.

22. An electrical switch as set forth in claim 21 wherein one of the first and second substrate comprises a compressible layer.

23. An electrical switch as set forth in claim 21 wherein said first substrate comprises a flexible circuit having an underlying compressible layer, and said second substrate is relatively rigid so that in the second position the flexible circuit is pushed into the compressible layer in the area immediately under at least the first and second sets of raised electrical features.

24. An electrical switch as set forth in claim 21 wherein said second substrate comprises a compressible layer, and further comprising a third rigid substrate underline said first substrate.

25. An electronic device as set forth in claim 1 wherein the second substrate comprises a semiconductor device.

* * * * *